US010017833B2

(12) United States Patent
Flehmig et al.

(10) Patent No.: US 10,017,833 B2
(45) Date of Patent: Jul. 10, 2018

(54) METHOD AND TOOL FOR HARDENING A HOLLOW PROFILE OF A STEEL WORKPIECE

(71) Applicants: THYSSENKRUPP STEEL EUROPE AG, Duisburg (DE); THYSSENKRUPP AG, Essen (DE)

(72) Inventors: Thomas Flehmig, Ratingen (DE); Martin Kibben, Dinslaken (DE); Jörg Gorschlüter, Hamm (DE)

(73) Assignees: THYSSENKRUPP STEEL EUROPE AG, Duisburg (DE); THYSSENKRUPP AG, Essen (DE)

( * ) Notice: Subject to any disclaimer, the term of this patent is extended or adjusted under 35 U.S.C. 154(b) by 222 days.

(21) Appl. No.: 14/849,253

(22) Filed: Sep. 9, 2015

(65) Prior Publication Data

US 2016/0068921 A1 Mar. 10, 2016

(30) Foreign Application Priority Data

Sep. 9, 2014 (DE) ..... 10 2014 112 968

(51) Int. Cl.

| | |
|---|---|
| ***C21D 9/00*** | (2006.01) |
| ***C21D 1/62*** | (2006.01) |
| ***C21D 1/00*** | (2006.01) |
| ***C21D 1/18*** | (2006.01) |
| ***C21D 6/00*** | (2006.01) |
| ***C21D 9/08*** | (2006.01) |

(52) U.S. Cl.

CPC ..... *C21D 1/18* (2013.01); *C21D 6/00* (2013.01); *C21D 9/0062* (2013.01); *C21D 9/085* (2013.01)

(58) Field of Classification Search

None

See application file for complete search history.

(56) References Cited

U.S. PATENT DOCUMENTS

| | | | | | |
|---|---|---|---|---|---|
| 3,475,014 | A | * | 10/1969 | Frank | C21D 1/62 266/129 |
| 5,176,871 | A | * | 1/1993 | Fukai | B29C 35/16 264/328.14 |
| 5,232,715 | A | | 8/1993 | Fukai | |

FOREIGN PATENT DOCUMENTS

| | | | |
|---|---|---|---|
| CN | 201172272 | Y | 12/2008 |
| CN | 101928818 | A | 12/2010 |
| CN | 202322928 | U | 7/2012 |
| DE | 69114813 | T2 | 7/1996 |
| EP | 0481868 | B1 | 11/1995 |
| EP | 1755801 | B1 | 4/2011 |

(Continued)

OTHER PUBLICATIONS

Office Action from German Patent Office dated Jul. 28, 2015 for German priority patent application No. 102014112968.7.

English language Abstract for CN 202322928 U.

*Primary Examiner* — Deborah Yee

(74) *Attorney, Agent, or Firm* — Thyssenkrupp North America, Inc.

(57) ABSTRACT

Disclosed herein is a method and tool for hardening a hollow profile of a steel workpiece having an interior space. The method includes the steps of providing a workpiece having a hollow profile, heating the hollow profile, placing the hollow profile of the steel workpiece in a hardening tool, and cooling the hollow profile from the inside by way of a cooling core having an exterior shape that is complimentary to that of the structural shape of the interior space of the hollow profile.

20 Claims, 1 Drawing Sheet

(56) References Cited

FOREIGN PATENT DOCUMENTS

| | | | | |
|---|---|---|---|---|
| FR | 2446985 | A1 | * | 8/1980 |
| JP | S60251222 | A | | 12/1985 |
| JP | 06-269839 | A | * | 9/1994 |

* cited by examiner

METHOD AND TOOL FOR HARDENING A HOLLOW PROFILE OF A STEEL WORKPIECE

CROSS-REFERENCE TO RELATED APPLICATIONS

This application claims priority to prior filed German Patent Application Serial No. DE102014112968.7 filed Sep. 9, 2014, the entire contents of which is hereby incorporated by reference herein.

FIELD

The present disclosure relates to a method and tool for hardening a hollow profile of a steel workpiece.

BACKGROUND

The hardening of workpieces made of steel, in particular made of a manganese-boron steel, is a sufficiently well-known method for adapting material properties. To this end, the workpiece is heated, depending on the material, to its austenitizing temperature, for example to about 930° C. in the case of a manganese-boron steel, and then quickly cooled or quenched. In order to produce, for example, bodywork components, the workpieces to be hardened are inserted into a hardening tool for cooling. Here, the workpiece undergoes at most a very small change in shape by calibration or pressing.

The fundamentals for the shape of the hardened workpiece are specified, in the case of indirect hot forming, in particular initially by cold forming. If a hollow profile is intended to be subjected to the hardening process, then the hardening tools generally merely ensure cooling of the workpiece via the outer face of the hollow profile.

A method in which a coolant in a hardening tool is made to pass through an interior space of the hollow profile and in the process to cool the hollow profile from the inside is known from the document EP 1 755 801 B1. However, the method is restricted to the hardening of hollow profiles which have also been shaped in the hardening tool.

Furthermore, workpieces made of a manganese-boron steel have a tendency for scale formation. Therefore, these steels are provided with oxidation-preventing layers such as AlSi, AlMg, zinc or other layers. These layers meet the desired requirements, but result in undesired side-effects, such as longer furnace residence times for inward diffusion, mixing with a material during a welding operation and/or additional costs as a result of the application and local removal of the layers on the manganese-boron steel.

Therefore, the prior art proposes carrying out heating operations on only uncoated workpieces and then removing the scale that has developed by way of a suitable method, for example by sand blasting. However, it has been found that subsequent removal of the scale is associated with higher additional costs, in particular for hollow profiles, the interior spaces of which, having a comparatively small cross section and a long length, can be reached only with difficulty. In addition, the scarcely avoidable soiling with scale residues results in increased cleaning outlay and increased tool wear.

SUMMARY

One object of the present disclosure is to provide a method for hardening a hollow profile of a steel workpiece, by which heat is dissipated as effectively as possible from the hollow profile during hardening and by which scale formation is avoided as far as possible.

In one aspect of the present disclosure, a method is disclosed for hardening a hollow profile of a steel workpiece having an interior space. The method includes the steps of providing a workpiece having a hollow profile, heating the hollow profile, placing the hollow profile of the steel workpiece in a hardening tool, and cooling the hollow profile. During the cooling step, the hollow profile is cooled from the inside by way of a cooling core having an exterior shape that is complimentary to that of the structural shape of the interior space of the hollow profile.

BRIEF DESCRIPTION OF THE DRAWINGS

The present invention is described in detail below with reference to the attached drawing figures, wherein.

DETAILED DESCRIPTION

Figure 1:
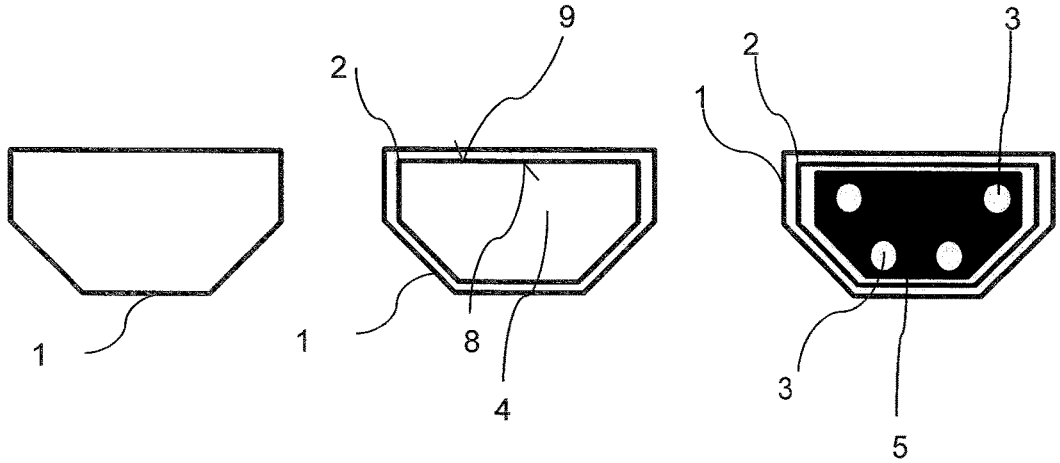
FIG. 1 is a schematic view depicting an embodiment of a method of hardening a hollow profile of a steel workpiece, as disclosed herein.

A method is disclosed herein for hardening a hollow profile of a steel workpiece having an interior space. One embodiment of the method of the present disclosure includes the steps of providing a workpiece having the hollow profile, heating the hollow profile, placing the hollow profile of the steel workpiece in a hardening tool, and cooling the hollow profile. During the cooling step, the hollow profile is cooled from the inside by way of a cooling core having an exterior shape that is complimentary to that of the structural shape of the interior space of the hollow profile.

Compared with the prior art, the hollow profile is cooled from the inside via the cooling core rather than making a cooling medium pass through the interior space of the hollow profile. As a result, it is possible to dispense for example with complicated provision systems which direct the cooling medium in a targeted manner into the interior space of the hollow profile. Furthermore, as a result of the structural shape of the cooling core, the cooling action can be distributed spatially and thus be controlled or influenced. As a result of the separation of the forming method and hardening, the cooling of the hollow profile from the inside can also be extended for example to hollow profiles which have already been shaped by cold forming.

Preferably, the cooling core has a cooling face via which the cooling core dissipates the heat of the hollow profile during cooling or quenching, in order to bring about a change in the microstructural state of the hollow profile during cooling. Furthermore, provision is also made for the hollow profile to be cooled from the outside during the cooling method step. To this end, provision is made for the hollow profile to be arranged in a receptacle of the hardening tool, wherein the receptacle is adapted to the structural shape of an outer face of the hollow profile. In particular, the receptacle has an active tool surface, via which the heat is dissipated from the heated hollow profile and thus cools the latter.

Advantageous configurations and developments of the invention can be gathered from the dependent claims, and from the description with reference to the drawings.

According to a further embodiment of the present invention, provision is made for the cooling core to be cooled by a cooling medium flowing through the cooling core or by an external cooling device. For example, the cooling core is surrounded by a cooling circuit which transports away the heat received from the cooling core. Preferably, the cooling core is repeatedly removed from the interior space of the hollow profile and arranged inside the interior space again. Temporally between the removal and arrangement in the interior space again, the cooling core is preferably cooled by an external cooling device, for example a cooling bath, a dry ice tank or a gas flood. As a result, it is advantageously possible to ensure that a cooling action of the cooling core is provided even when the cooling core heats up during the cooling of the hollow profile.

According to a further embodiment of the present invention, provision is made for the cooling core to be at least partially in contact with the interior space. Preferably, the cooling core is in extensive contact with the inner face or with the inner wall of the hollow profile. As a result of extensive contact, the heat can be transmitted directly and effectively from the hollow profile, with the result that the dissipation of heat is improved further.

According to a further embodiment of the present invention, provision is made for the method step of arranging the hollow profile in the hardening tool to be carried out temporally after the method step of heating the hollow profile. It is also conceivable for heat to be passed into the hollow profile via the hardening tool. As a result, it is advantageously possible to dispense with transport of the heated hollow profile. It is also conceivable for the cooling core to already be inserted into the hollow profile during the method step of arranging the hollow profile in the hardening tool. As a result, the insertion of the cooling core into the hollow profile can advantageously be made easier and time saved. Furthermore, it is conceivable for the hollow profile to be heated via the cooling core arranged in the hollow profile. For example, the cooling core comprises a heating device by way of which the cooling core supports the heating by the hardening tool during the heating method step. As a result of this double functionality, the heating and quenching treatment by the cooling core can be positively influenced.

According to a further embodiment of the present invention or according to a further subject of the present invention, provision is made of a method for hardening a hollow profile having an interior space, comprising the following method steps of:

providing the hollow profile, heating the hollow profile, arranging the hollow profile in a hardening tool, and cooling the hollow profile, wherein, in the method step of cooling the hollow profile, a surface layer, preferably a scale layer, is removed from the hollow profile. In particular, provision is made to already remove the surface layer, in particular the scale layer, during transfer into the hardening tool, i.e. in the arranging method step. As a result, a possible scale layer is advantageously removed again immediately after its formation.

According to a further embodiment of the present invention, provision is made for dry ice to be applied to an outer face of the hollow profile and/or to an inner face of the hollow profile in order to remove the surface layer. As a result of the dry ice, an additional cooling action can advantageously be effected, and removing the scale layer which is formed.

According to a further embodiment of the present invention, provision is made for the surface layer to be removed by way of a thin lance in the method step of cooling the hollow profile, wherein a medium for removing the surface layer which is introduced via the lance. In particular, a scale layer is removed from the inner face of the hollow profile. Alternatively or in addition, the thin lance can also be used for cooling purposes, in particular for additional, supportive cooling. By way of the lance, it is possible to also remove the scale layer from poorly accessible regions in the interior space of the hollow profile and/or to cool points in the interior space of the hollow profile that are locally hard to reach.

According to a further embodiment of the present invention or according to a further subject of the present invention, provision is made of a method for hardening a hollow profile having an interior space, comprising the following method steps of:

providing the hollow profile, heating the hollow profile, arranging the hollow profile in a hardening tool, and cooling the hollow profile, wherein, in the cooling method step, a gas is conducted through an access duct in the hardening tool in the direction of the hollow profile.

By way of the gas, the tendency for scale formation during hardening is suppressed. In contrast to the prior art, flooding the entire hardening tool is advantageously dispensed with. Such laborious flooding of the entire hardening tool additionally has the drawback that, for industrial safety reasons, a comparatively large amount of gas would have to be laboriously sucked out again. Instead, it is possible here to use the access duct to conduct the gas in a targeted manner onto the hollow profile, in particular the outer face thereof and optionally the inner face thereof. Compared with integral flooding, gas can advantageously be saved as a result. It is also conceivable to collect the gas, clean it, cool it and pass it back into the circuit to the hardening tool, directly on the side at which it flows out.

According to a further embodiment of the present invention, provision is made for an inert gas to be used. For example, argon or nitrogen is used as the gas. The inert gases advantageously suppress the scale formation.

According to a further embodiment of the present invention, provision is made for the gas to be conducted via a distribution system, for example in the form of flow grooves in the hardening tool. As a result, the gas can be distributed extensively over the outer face of the hollow profile and the protective action of the gas acts equally on the outer face of the hollow profile.

A further subject of the present invention is a hardening tool for hardening a hollow profile, wherein the hardening tool comprises a receptacle adapted to the outer face of the hollow profile, wherein the hardening tool has a cooling core adapted to an interior space of the hollow profile, wherein, during a cooling operation, the hollow profile is arranged in the receptacle and the cooling core is arranged in the interior space of the hollow profile, and the cooling core cools the hollow profile, preferably from the inside. Preferably, the gas can also be conducted via a distribution system, for example in the form of flow grooves on or in the cooling core. Provision is furthermore made for the receptacle to cool the hollow profile arranged in the receptacle from the outside.

Compared with the prior art, with the device according to the invention, the cooling core of the hardening tool can be arranged in an uncomplicated manner within the hollow profile and effectively cool the hollow profile. In this case, during cooling, the cooling core is preferably in extensive contact with the inner face of the hollow profile and directly dissipates the heat from the hollow profile via the contact. To this end, provision is in particular made for the structural shape of the cooling core to be adapted to the interior space of the hollow profile. For optimal heat transfer and dissipation, provision is furthermore made for the receptacle to be adapted to the outer face of the hollow profile. In particular, the receptacle is adapted to the hollow profile in that a receiving surface on which the hollow profile rests is configured as a kind of negative to the outer face of the hollow profile. As a result, the hollow profile rests as extensively as possible in the hardening tool against the receptacle, thereby fulfilling the requirements for optimal heat dissipation. Preferably, the cooling core is adapted with a precise fit to the available space in the interior space. It is furthermore conceivable for the receptacle and/or the cooling core to comprise a heating device, wherein the heating device is intended to heat the hollow profile arranged in the hardening tool. It is also conceivable for the receptacle and the cooling core to be adapted individually to the type of hollow profile.

According to a further embodiment of the present invention, provision is made for the cooling core to be exchangeable and/or to comprise a cooling circuit. As a result, the effectiveness of heat dissipation can be improved further, with the result that rapid cooling can be ensured for successful hardening.

According to a further embodiment or a further subject of the present invention, provision is made of a hardening tool for hardening a hollow profile, wherein the hardening tool comprises a receptacle adapted to the outer face of the hollow profile, wherein the hardening tool has an access duct, wherein a gas, preferably an inert gas such as argon or nitrogen, for example, is conductible in the direction of the hollow profile arranged in the hardening tool via the access duct. Compared with the prior art, the hardening tool with the access duct has the advantage of it being possible to dispense with integral and laborious flooding of the hardening tool. As a result, it is advantageously possible to save gas. In this case, the gas conducted onto the hollow profile advantageously reduces the tendency of the hollow profile for scale formation, with the result that the quality of the hardened hollow profile is improved. It is also conceivable to collect the gas, clean it, cool it and pass it back into the circuit to the hardening tool, directly on the side at which it flows out. Provision is furthermore made for the hardening tool to comprise a distribution system for the gas, for example in the form of flow grooves in the hardening tool. In particular, the distribution system is configured such that the gas is conducted onto a sufficiently large number of regions of the outer face of the hollow profile. As a result, scale formation on the outer face can be prevented as extensively as possible. Preferably, gas can also be conducted via a distribution system, for example in the form of flow grooves on or in the cooling core.

According to a further embodiment of the present invention, provision is made for an outlet opening of the access duct to adjoin the hollow profile arranged in the hardening tool. Via the outlet opening, the inert gas is conducted directly onto the outer face and optionally inner face of the hollow profile.

Further details, features and advantages of the invention can be gathered from the drawings and from the following description of preferred embodiments with reference to the drawings. In this case, the drawings illustrate merely exemplary embodiments of the invention which do not restrict the concept of the invention.

In the different figures, identical parts are always provided with the same reference signs and are therefore generally also each only identified or mentioned once.

FIG. 1 illustrates a method according to a first exemplary embodiment of the present invention. Provision is made here for a hollow profile 2 first of all to be provided, wherein the hollow profile 2 comprises an interior space 4. Provision is preferably made for the hollow profile 2 to be produced in a preceding method step, for example by cold forming, and subsequently to be intended to be hardened. In the method step of providing the hollow profile 2, the hollow profile 2 is to this end preferably heated, for example to 930° C., and subsequently transferred into a hardening tool 1, wherein the hardening tool 1 comprises a, preferably die-like, receptacle which is adapted to the structural shape of the hollow profile 2, in particular to the outer shape or outer face 9 thereof. In particular, the hollow profile 2 is arranged with a precise fit in or within the receptacle of the hardening tool. "Adapted" means in particular that a receiving face of the receptacle, with which the hollow profile 2 is in contact in the hardening tool 1, is configured as a kind of negative to the outer face of the hollow profile 2. To complete hardening, provision is made for the hollow profile 2 to be cooled or quenched, preferably rapidly. Provision is made in particular for the hollow profile 2 to be cooled not only from the outside, i.e. from the outer face 9 via the receptacle of the hardening tool 1, but also from the inside, i.e. from the inner face 8 of the hollow profile. For cooling from the inside, provision is made in particular of a cooling core 5, which is arranged in the interior space 4 of the hollow profile 2. Preferably, the cooling core 5 is adapted in terms of its shape to the interior space 4, in particular to the available space provided by the interior space 4, and is in contact for example at least partially with the inner face 8 of the hollow profile. In this case, it is conceivable for the cooling core 5 to be provided as an exchangeable part of the hardening tool 1, which is arranged in the interior space 4 of the hollow profile when the hollow profile 2 is received in the hardening tool 1. By way of the cooling core 5, the cooling can be controlled in a comparatively better manner during hardening than in the case of methods in which a cooling medium is sent through the interior space 4 of the hollow profile 2. For example, by way of the structural shape, it is possible to co-determine which parts of the interior space 4 should be cooled more greatly. However, it is also conceivable for the cooling core 5 to comprise a cooling system which directs a cooling medium in a targeted manner to a particular region in the interior space 4, in order for example to be able to provide hollow profiles as bodywork components with locally different properties. By contrast, when the cooling medium is simply passed through, the cooling medium passing through is cooled and can then possibly no longer provide the desired cooling performance, as previously disclosed in the prior art. Furthermore, dealing with a solid or rigid cooling core 5 is less complicated than dealing with a gaseous or liquid coolant and allows for example the integration of measuring devices, which determines for example the temperature at the inner face 8 of the hollow profile. The cooling core 5 can be removed repeatedly from the interior space 4 of the hollow profile 2 by simple means. Before the cooling core 5 is arranged within the interior space 4 of the hollow profile 2 again, provision is made to cool the cooling core 5 in an external cooling device and subsequently to arrange it in the hollow profile 2 again. For example, the cooling core 5 is cooled between two cooling cycles in a cooling bath, a dry ice tank and/or a gas flood.

Figure 2:
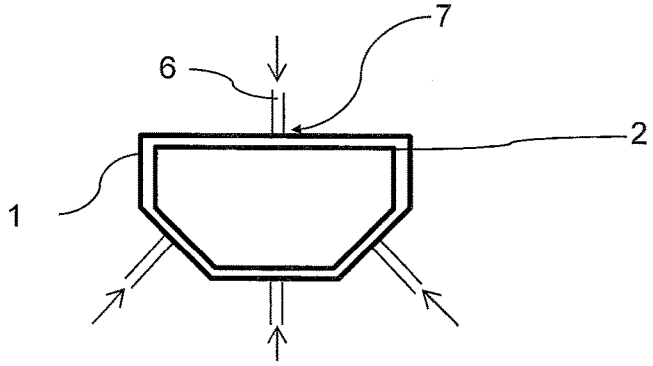
FIG. 2 is a schematic view depicting an alternate embodiment of a method of hardening a hollow profile of a steel workpiece, as disclosed herein.

FIG. 2 schematically illustrates a hardening tool 1 for a method for hardening a hollow profile 2 according to a second embodiment of the present invention. In this case, the illustrated hardening tool 1 is intended to cool the hollow profile 2 from the outside, i.e. from the outer face 9 thereof. In this case, it is conceivable for the external cooling illustrated in FIG. 2 to be combined with the internal cooling of the first exemplary embodiment. In this case provision is made, for the external cooling, for the hardening tool 1 to comprise an access duct 6, via which a gas, preferably an inert gas such as nitrogen or argon, is conducted directly onto the outer face 9 of the hollow profile 2 arranged in the hardening tool 1. As a result of the gas, scale formation is advantageously avoided or the tendency for scale formation is reduced. Preferably, an outlet opening 7 of the access duct 6 opens out directly at the outer face 9 of the hollow profile 2. Preferably, the outlet openings are integrated into the receptacle of the hardening tool 1, i.e. the active tool surface thereof. Provision is furthermore made for the hardening tool 1 to comprise a plurality of regularly or irregularly arranged access ducts 6. Through the access ducts 6, the gas can be conducted in a targeted manner onto the hollow profile 1, without the entire hardening tool 1 having to be flooded. Provision is furthermore made for the gas to be distributed via flow grooves onto different regions of the outer face 9 of the hollow profile 2. As a result, scale formation on the hollow profile 2 can be avoided as extensively as possible.

LIST OF REFERENCE SIGNS

1 Hardening tool
2 Hollow profile
3 Cooling system
4 Interior space
5 Cooling core
6 Access duct
7 Outlet opening
8 Inner face of the hollow profile
9 Outer face of the hollow profile

What is claimed is:

1. A method of hardening a hollow profile of a steel workpiece, the method comprising:

providing a steel workpiece having a hollow profile defining an interior space therein;

heating the hollow profile of the steel workpiece;

placing the hollow profile of the steel workpiece in a receptacle of a hardening tool such that the hollow profile is in contact with a receiving face of the receptacle in the hardening tool, with the receiving face being reciprocal of an outer face of the hollow profile; and cooling the hollow profile in the hardening tool by insertion of a cooling core into the interior space of the hollow profile, the cooling core having a shape complimentary to that of the interior space of the hollow profile.

2. The method of claim 1, further comprising directing a flow of a cooling medium through an interior of the cooling core, so as to cool the cooling core.

3. The method of claim 1, further comprising cooling the cooling core by an external device.

4. The method of claim 1, wherein the cooling core is at least partially in contact with an inner surface of the hollow profile of the workpiece in the interior space.

5. The method of claim 1, wherein said step of placing the hollow profile of the steel workpiece in the hardening tool is performed after said step of heating the hollow profile.

6. The method of claim 1, further comprising:

removing a surface layer from the hollow profile during said cooling step.

7. The method of claim 6, wherein said removing step includes applying dry ice to at least one of an outer surface of the hollow profile or the inner surface of the hollow profile in order to remove the surface layer.

8. The method of claim 6, wherein said removing step includes applying a medium for removing the surface layer to the surface layer via a lance, so as to remove the surface layer.

9. The method of claim 1, wherein during said cooling step, directing a gas through an access duct disposed in the hardening tool in the direction of the hollow profile.

10. The method of claim 9, wherein the gas is an inert gas.

11. The method of claim 9, wherein the gas is directed via a distribution system.

12. A hardening tool for hardening a hollow profile of a steel workpiece, the hollow profile defining an interior space therein, the hardening tool comprising:

a receptacle having an interior shape that is complimentary to an outer shape of the hollow profile of the steel workpiece, and configured to permit the hollow profile to be inserted therein during a cooling operation of the hollow profile, wherein the receptacle comprises a receiving face that is reciprocal of an outer face of the hollow profile and is configured to contact the outer face of the hollow profile; and a cooling core having an exterior shape that is complimentary to a shape of the interior space of the hollow profile of the steel workpiece, and configured to be inserted into the interior space of the hollow profile during a cooling operation thereof so as to permit the cooling core to cool the hollow profile of the steel workpiece.

13. The hardening tool of claim 12, wherein said cooling core is configured to be exchangeable.

14. The hardening tool of claim 12, wherein said cooling core comprises a cooling circuit.

15. The hardening tool of claim 12, further comprising:

an access duct defined in at least one of a wall of said receptacle or said cooling core, and configured to direct a flow of gas there through toward the hollow profile of the steel workpiece when the hollow profile is disposed in the hardening tool.

16. The hardening tool of claim 15, further comprising:

an access duct outlet opening in communication with said access duct and defined in at least one of a wall of said receptacle or said cooling core and configured to permit the flow of the gas to be blown onto the hollow profile of the steel workpiece.

17. The method of claim 1 wherein the heating of the hollow profile takes place in the receptacle of the hardening tool.

18. The method of claim 1 wherein the cooling core performs the heating of the hollow profile.

19. The method of claim 1 wherein during the cooling step gas is directed through flow grooves disposed in cooling core.

20. The method of claim 1 wherein during the cooling step gas is directed through an access duct directly onto the outer face of the hollow profile.

* * * * *